US006126353A

United States Patent [19]

Mullin et al.

[11] Patent Number: 6,126,353

[45] Date of Patent: Oct. 3, 2000

[54] CURLED FINGER HINGE BINDER

[75] Inventors: Howard Mullin, 86 Kilroy Way, Atherton, Calif. 94027; Klaus Honeker, 260 Cinnabar Rd., Woodside, Calif. 94062

[73] Assignees: Howard Mullin; Klaus Honeker, both of Atherton, Calif.

[21] Appl. No.: 08/929,337

[22] Filed: Sep. 13, 1997

[51] Int. Cl.[7] ..... B42F 3/02

[52] U.S. Cl. ..... 402/46; 402/56; 402/39

[58] Field of Search ..... 402/46, 30, 55, 402/38, 36, 20, 62

[56] References Cited

U.S. PATENT DOCUMENTS

| | | | |
|---|---|---|---|
| 2,322,596 | 6/1943 | Schade . | |
| 2,371,566 | 3/1945 | Williams . | |
| 2,511,153 | 6/1950 | Emmer . | |
| 2,754,826 | 7/1956 | Berberich . | |
| 4,349,289 | 9/1982 | Cardellini | 402/30 |
| 4,349,290 | 9/1982 | Cardellini . | |
| 4,355,916 | 10/1982 | Cardellini . | |
| 4,441,834 | 4/1984 | Cardellini | 402/55 |
| 4,486,112 | 12/1984 | Cummins . | |
| 4,607,970 | 8/1986 | Heusinkveld | 402/20 |
| 4,773,787 | 9/1988 | Chang . | |
| 4,832,370 | 5/1989 | Jones . | |
| 4,900,211 | 2/1990 | Vercillo . | |
| 5,051,050 | 9/1991 | Scharer . | |
| 5,338,125 | 8/1994 | Forsse et al. | 402/46 |
| 5,445,467 | 8/1995 | Peleman . | |
| 5,667,324 | 9/1997 | Aoki | 402/46 |
| 5,788,392 | 8/1998 | Cheung | 402/38 |
| 5,827,004 | 10/1999 | Kim | 402/46 |

*Primary Examiner*—Willmon Fridie, Jr.
*Assistant Examiner*—Alisal Thurston
*Attorney, Agent, or Firm*—Douglas A. Chaikin; Peninsula IP Group

[57] ABSTRACT

A loose leaf binder includes a first half binder section having a plurality of curled fingers spaced regularly apart and a second half binder section having a corresponding plurality of correspondingly spaced curled fingers. Each of the first and second half binder sections include a plurality of protruding tabs and a plurality of tab openings, each of the plurality of protruding tabs of the first half binder section being capable of mating with a corresponding one of the plurality of tab openings of the second half binder section. When the first half binder section is mated with the second half binder section, the protruding tabs of both the first and second half binder sections snap-fit with corresponding tab openings of both the first and second half binder sections to form the loose leaf binder and to cause the curled fingers of the first and second half binder sections to overlap. The first half binder section may be identical to the second half binder section.

11 Claims, 3 Drawing Sheets

CURLED FINGER HINGE BINDER

BACKGROUND OF THE INVENTION

1. Field of the Invention

This invention relates to devices used for carrying paper goods and the like and more particularly to loose leaf binder devices such as curled finger binders, which retain perforated loose leaves and note book paper.

2. Description of the Related Art

Curled finger binders are versatile devices, offering a simple, inexpensive and aesthetically pleasing means for binding of loose leaves, typically note book paper. Such binders allow corporate executives to distribute bound materials during presentations, organizations to disseminate information in booklet form and allow schools and universities to gather information from a wide variety of sources and to literally bind them together, for distribution to students. Such binders allow virtually anyone to create their own book, without resorting to more expensive devices such as three rings binders and the like.

Typically, binders include a spine and overlapping extensions in the shape of curled fingers that are inserted in corresponding rectangular perforations in the leaves to be bound. Conventionally, a separate uncurling tool is needed to separate the normally overlapping curled fingers, to thereby allow the leaves to be bound to be inserted therebetween. Once the sheets are inserted between the separated curled fingers, the uncurling tool is removed, allowing the fingers to insert into their corresponding rectangular perforations in the sheets, to encircle them and to once again overlap. This effectively binds the sheets of paper or other loose leaves together, and provides them with a spine.

Typical of such binders is the binder shown in U.S. Pat. No. 5,051,050 to Scharer, the specification of which is incorporated herewith by reference. This reference shows a perforation machine 10 for creating the rectangular perforations in the loose leaves, and shows a typical binder 44. To separate the curled fingers of the binder, a binder opening tool 90 is used, as shown in FIGS. 6, 6A and 6B, of this reference. Once separated, the sheets of paper may be inserted between the curled fingers. The opening tool 90 is then removed, allowing the fingers to insert into the rectangular perforations created in the loose leaves by the perforation machine 10, to bind the sheets together.

U.S. Pat. No. 4,900,211 to Vercillo, incorporated herewith by reference, also shows a similar curled finger opening tool, wherein a long thin device is inserted within the inside diameter created by the fingers, the proximal section of the tool being wider than its distal section. When the proximal section is pushed or pulled through the curled fingers, the curled fingers are separated by the width of the proximal section of the tool. Sheets of perforated paper may then be inserted between the curled fingers, and the tool removed.

Other means for opening and securing curled finger binders to loose leaves have been proposed. One such is U.S. Pat. No. 2,754,826 to Berberich, the specification of which is incorporated by reference. In this reference, normally separated curled fingers are interlocked with a slide acting like a zipper. By sliding the slide, recesses on the curled fingers cooperate with mating recesses on the spine and snap together.

Similarly, U.S. Pat. No. 4,355,916 to Cardellini, incorporated herein by reference, teaches a loose leaf binder formed of two separate half sections joined by a suitably bent metal wire. To close the binder, a slide 12 is longitudinally moved to keep the half rings from separating.

Yet another binder structure was proposed in U.S. Pat. No. 4,349,290 to Cardellini, the specification of which is also incorporated by reference, in which cooperating half rings are interconnected, again by wire links. A mating mechanism is located at the free ends of the binder half rings.

All of the above-described devices either require a separate tool to separate the curled fingers or include a separate mechanism to lock two halves of the binder device together. These approaches increase the complexity of the binders, as well as their cost. Additionally, they utilize many components, increasing the likelihood that one of the components will break.

What is needed, therefore, is a binder device that is simple, easy to use and inexpensive. What is also needed, is a binder device which does not require finger opening tools to open the binding. What is also needed is a binder device that does not require metal wires, clasps, slides or the like.

SUMMARY OF THE INVENTION

It is, therefore, an object of the present invention to provide a loose leaf binder which is simple, easy to use and inexpensive.

It is an additional object of the present invention to provide a loose leaf binder which does not require a separate tool to open the curled fingers thereof to allow the loose leaves to be inserted therein.

It is an additional object of the present invention to provide a loose leaf binder that does not comprise wires, clasps, slides or the like.

In accordance with the above objects and those that will be mentioned and will become apparent below, the loose leaf binder according to the present invention comprises:

a first half binder section having a plurality of curled fingers spaced regularly apart; and a second half binder section having a corresponding plurality of correspondingly spaced curled fingers, each of the first and second half binder sections including a plurality of protruding tabs and a plurality of tab openings, each of the plurality of protruding tabs of the first half binder section being capable of mating with a corresponding one of the plurality of tab openings of the second half binder section.

When the first half binder section is mated with the second half binder section, the protruding tabs of both the first and second half binder sections snap fit with corresponding tab openings of both the first and second half binder sections to form the loose leaf binder and to cause the curled fingers of the first and second half binder sections to overlap.

An advantage of this embodiment is that a loose leaf binder may be fabricated from only two mating components, thereby increasing reliability, and decreasing complexity and cost of the device.

In an exemplary embodiment, each of the first and second half binder sections are substantially semi-circular in shape. In another exemplary embodiment, each of the first and second half binder sections comprise a leading edge where the first and second half sections meet to form a spine of the binder, the leading edge including a plurality of flared portions, each of the plurality of flared portions being aligned with a corresponding tab opening. An advantage of this embodiment is that the flared portions facilitate the mating of the protruding portions with the corresponding tab openings. According to another exemplary embodiment, the first and second binder half sections each comprise a groove running an entire length thereof, the plurality of protruding tabs of each of the first and second half binder sections being partially disposed within the groove of a corresponding one of the first and second half binder sections, the groove in each of the first and second half binder sections imparting structural rigidity to the first and second half binder sections and to the loose leaf binder.

Another embodiment of the present invention is a two piece loose leaf binder comprising:

a pair of elongated strips, each strip having curled fingers regularly and correspondingly spaced therealong, each strip comprising a plurality of protruding tabs and tab openings, the protruding tabs of one strip of the pair being capable of mating with the tab openings of the other pair. The protruding tabs of one strip of the pair mate with the tab openings of the other strip of the pair to snap-fit therewith to complete the two piece loose leaf binder and to cause the curled fingers of the pair of elongated strips to overlap with one another.

Another exemplary embodiment of the loose leaf binder according to the present invention comprises:

a pair of identical half binder sections, each half binder section of the pair including a plurality of curled fingers for encircling loose leaves, one half binder section of the pair being capable of mating with the other half binder section of the pair via a plurality of protruding tabs and mating tab openings alternately disposed along a length of each of the pair of identical half binder sections. In this embodiment, the protruding tabs of one half binder section are capable of mating with the tab openings of the other half binder section to assemble the loose leaf binder.

An advantage of this embodiment is that a loose leaf binder may be formed of a pair of identical half binder sections, thus again lowering complexity, and even further decreasing manufacturing complexity and costs.

In another embodiment, the present invention is a loose leaf binder half section, comprising:

a plurality of regularly spaced curled fingers for encircling loose leaves;

a plurality of protruding tabs regularly spaced along a length of the half section;

a plurality of tab openings disposed along the length of the half section, the plurality of tab opening alternating with the plurality of protruding tabs; and a groove formed along the length of the half section, a portion of each of the plurality of protruding tabs being disposed within the groove. A loose leaf binder may be formed by two exemplars of such a loose leaf binder half section, by causing the plurality of protruding tabs of each of the two binder half sections to face the corresponding plurality of tab openings of the other of the two half binder sections, and by snap-fitting the plurality of protruding tabs to the corresponding tab openings.

It is an advantage of this embodiment that, by manufacturing a single piece, a loose leaf binder may be formed by utilizing two such half sections and joining them to form a complete loose leaf binder assembly.

BRIEF DESCRIPTION OF THE DRAWING

For a further understanding of the objects and advantages of the present invention, reference should be made to the following detailed description, taken in conjunction with the accompanying drawings, in which like parts are given like reference numerals and wherein.

DETAILED DESCRIPTION OF THE INVENTION

Figure 1:
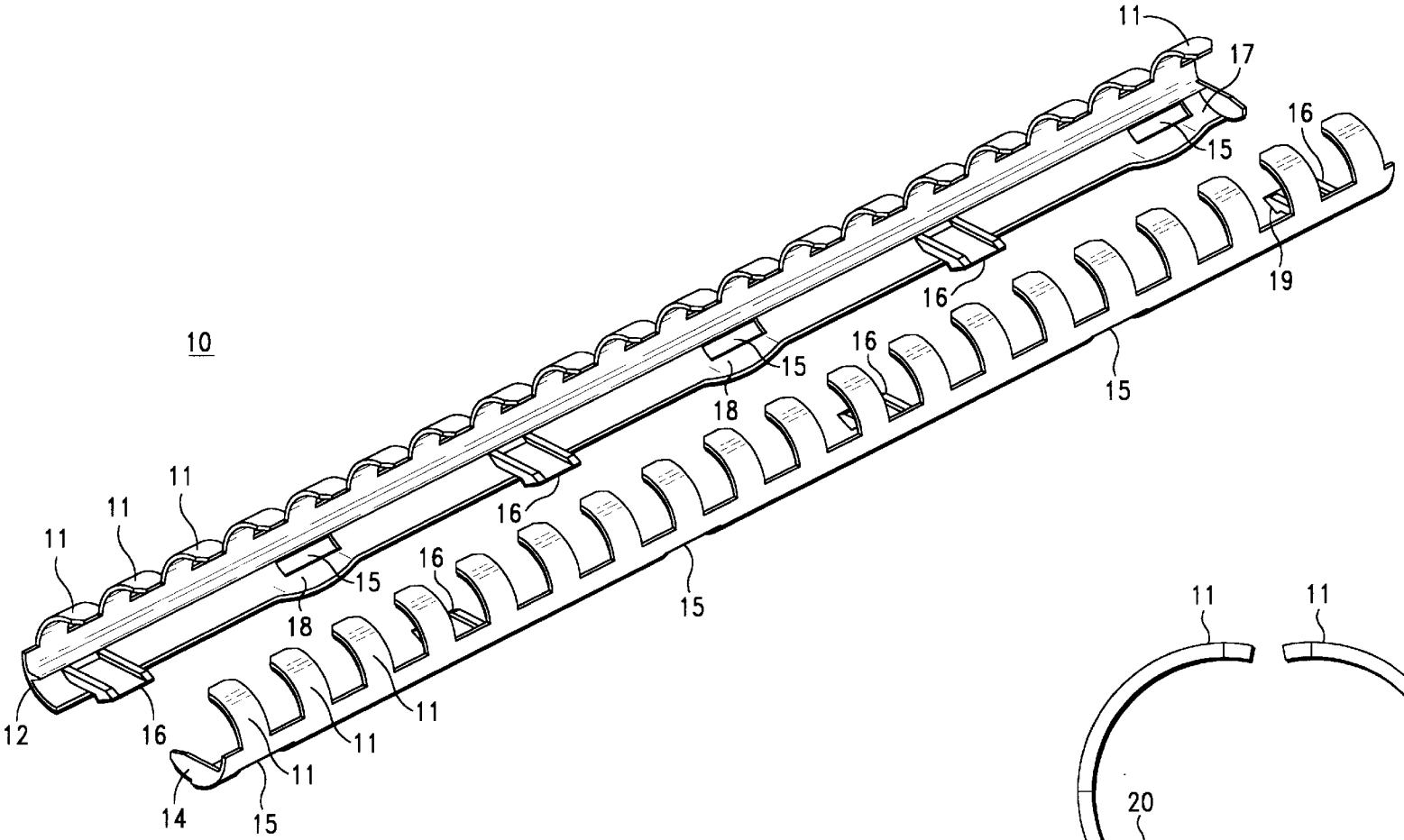
FIG. 1 shows an embodiment of a loose leaf binder according to the present invention, the two binder half sections separated for clarity of detail.
Figure 2:
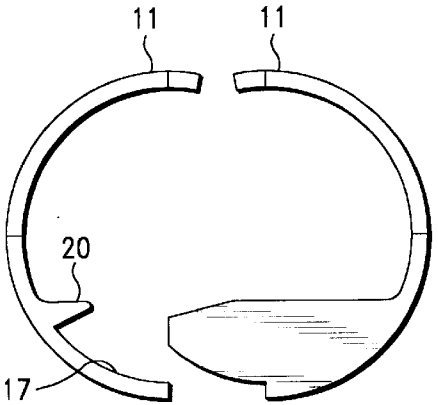
FIG. 2 is a profile view of the two half binder sections of FIG. 1.

FIG. 1 shows an embodiment of the loose leaf binder 10 according to the present invention. The loose leaf binder generally designated by numeral comprises two half binder sections, namely a first half binder section 12 and a second half binder section 14, each in the shape of an elongated strip. Each of the binder half sections 12 and 14 have a plurality of curled fingers 11 spaced regularly apart. Suitably perforated leaves, usually paper, can be inserted into the binder, each of the curled fingers 11 curling around a perforation. Each of the binder half sections 12 and 14 have a semi-circular shape, so that the loose leaf binder 10 assumes a substantially circular shape when the two binder half sections 12 and 14 are mated to one another.

Each of the first and second binder half sections 12 and 14 includes a plurality of protruding tabs 16 and a plurality of tab openings 15. The protruding tabs 16 and the plurality of tab openings 15 are regularly and alternately disposed along the lengths of each of the binder half sections 12 and 14. The tab openings 15 are dimensioned so as to mate with the protruding tabs 16. Indeed, when the loose leaf binder 10 is assembled by joining the first binder half section 12 to the second binder half section 14, the protruding tabs 16 of the first binder half section 12 mate with the tab openings 15 of the second binder half section 14. Likewise, the tab openings 15 of the first binder half section 12 mate with the protruding tabs 16 of the second binder half section 14.

Figure 3:
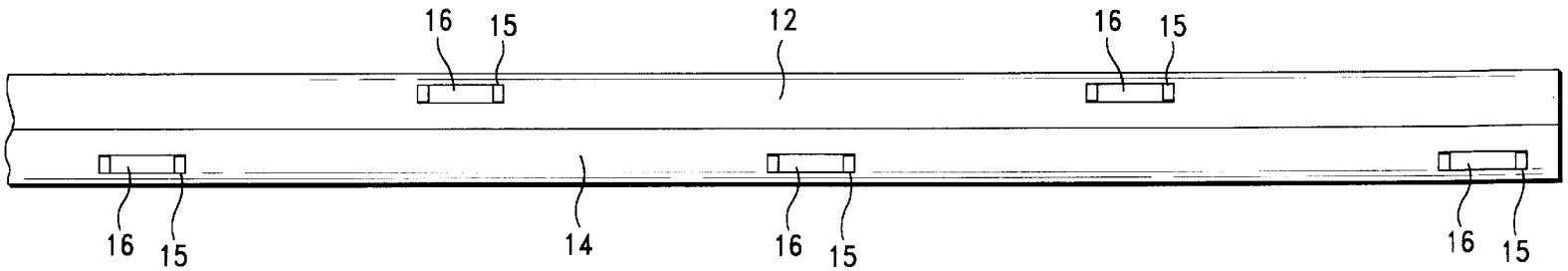
FIG. 3 shows a loose leaf binder according to the present invention, with the two half binder sections fitted together, as seen from the spine.

Each of the first binder half section 12 and the second binder half section 14 have a leading edge 21. The leading edge 21, as shown in FIGS. 1 and 3, is the edge where the first and second binder half sections 12, 14 meet to form the spine 22 of the binder 10. The leading edges 21, of the first and second binder half sections 12 and 14 include a plurality of flared portions 18, The flared portions 18 are aligned with the tab openings 15, and facilitate the mating of the protruding tab 16 with the tab openings 15.

Figure 5:
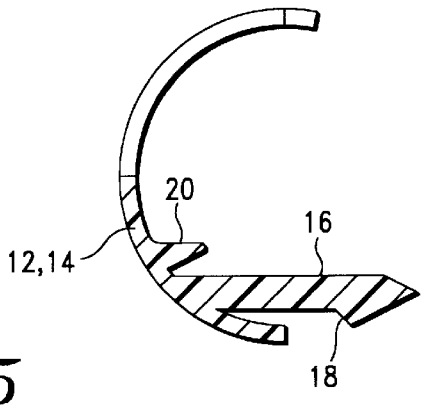
FIG. 5 depicts a detail of one of the half binder sections, to show one of the projecting tabs.

FIG. 5 shows a detail of one of the protruding tabs 16. As shown, the protruding tab 16 is mated to a corresponding tab opening 15 (not shown in FIG. 5) by sliding leading inclined surface on the flared portion 18 (FIG. 1) of leading edge 21 (FIG. 1) until catch 24 engages the tab opening 15 to snap-fit one half binder section 12 to the other binder half section 14.

Figure 4:
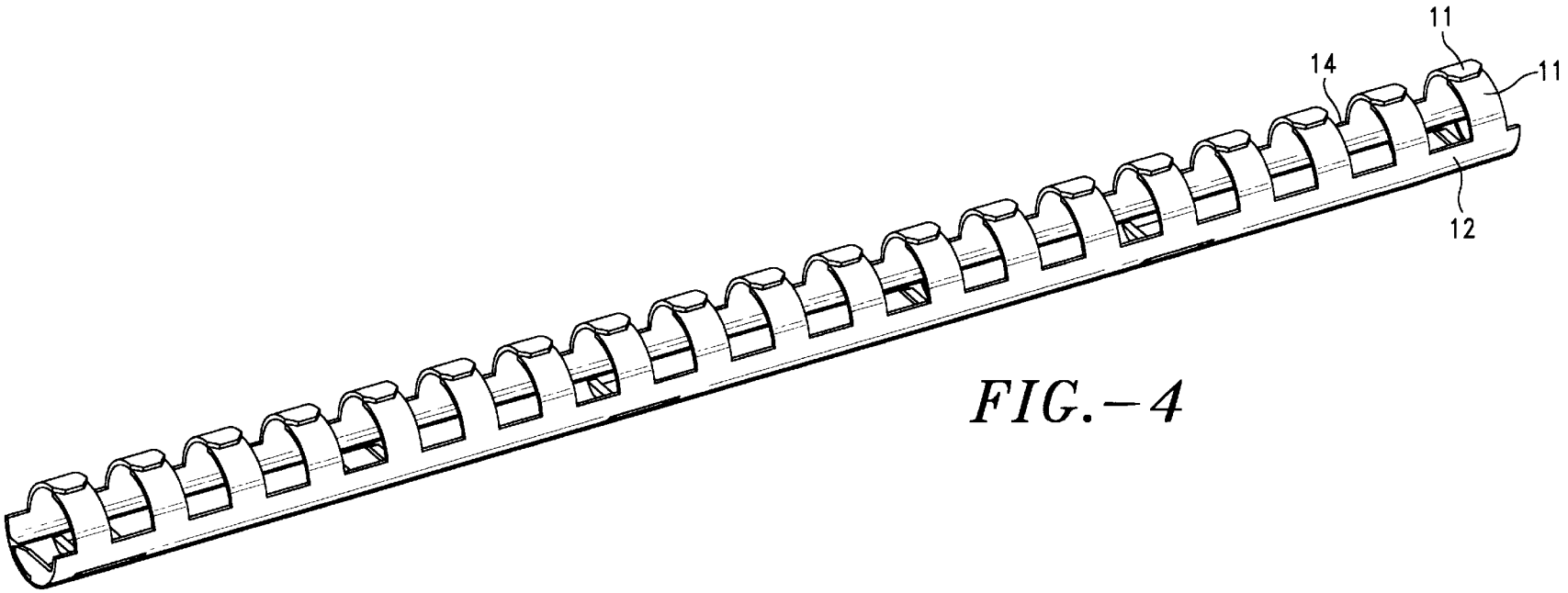
FIG. 4 is a perspective view of the loose leaf binder according to the present invention, with the two half binder sections fitted together.

When the protruding tabs 16 are snap-fit in this manner to the tab openings 15, the curled fingers 11 of the first binder half section 12 overlap the fingers 11 of the second binder half section 14, in the manner shown in FIG. 4. The assembly of the first and second binder half sections 12 and 14 form a substantially circular loose leaf binder, again as shown in FIG. 4.

Each of the first and second binder half sections 12 and 14 include a groove 17 running the entire length thereof. The protruding tabs 16 of the first and second binder half sections 12, 14 are partially disposed within the groove 17, as shown in FIGS. 1 and 5. The groove 17 imparts structural rigidity to the first and second binder half sections 12 and 14, and also to the assembled loose leaf binder 10, when the two binder half sections 12 and 14 are mated to one another. The groove 17 is formed by a lip 20 (FIGS. 4 and 5) running the length of both binder half sections 12 and 14. As shown in FIG. 4, when the first binder half section 12 is mated and snap-fitted to the second binder half section 14, the lips 20 are level with one another, and provide substantially level surfaces for the perforated paper to be inserted in the loose leaf binder.

In FIG. 1, the first binder half section 12 is identical to the second binder half section 14. To assemble a loose leaf binder 10 according to one embodiment of the present invention, all that is required is to take two identical binder half sections as previously described, and rotate one of them relative to the other, to cause the protruding tabs 16 of one binder half section to face the tab openings 15 of the other binder half section, as shown in FIG. 1. The two identical binder half sections 12, 14 may now be mated to one another by snap-fitting the protruding tabs 16 to the tab openings 15.

Thus, one exemplary embodiment of the present invention is a single loose leaf binder half section, such as shown at 12 in FIG. 1, which includes a plurality of regularly spaced curled fingers 11 for encircling loose leaves. This single binder half section 12 also includes a plurality of protruding tabs 16 regularly spaced along the length of the half section 12. Alternating with the protruding tabs 16 are a plurality of tab openings 15.

It is apparent that, by taking two exemplars of such a loose leaf binder half section 12, and rotating one relative to the other, a loose leaf binder 10 according to the present invention may be formed, by snap-fitting the two exemplars together in the manner described above.

By only employing a single binder half section designed for an entire loose leaf binder, the number of different components designs is reduced to its smallest possible limit: one component design. This means that manufacturing costs are lowered, since only one part design need be produced, as each binder 10 only requires two identical binder half sections, such as two identical binder half sections 12. This also eases the assembly of such binder, as the end users need not keep track of which half is which. Therefore, the end user can take any two such binder halves, and be assured that these two parts will mate to form the intended loose leaf binder.

Figure 6:
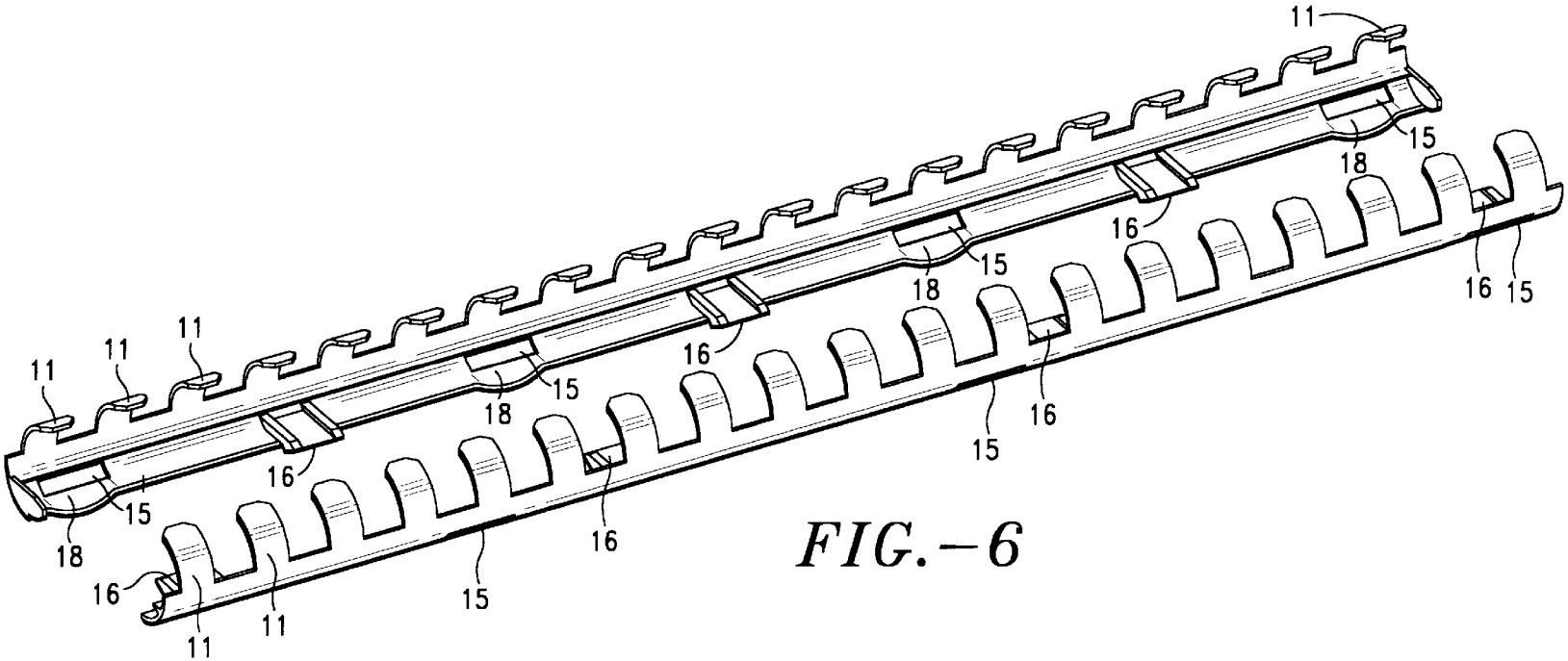
FIG. 6 shows another embodiment of a two piece loose leaf binder according to the present invention.

Of course, the present invention is not limited to the case wherein the two binder half sections 12, 14 are identical. Indeed, if the binder half section 12 were to include protruding tabs 16 at each end thereof, as shown in FIG. 6, it would be impossible to simply rotate another exemplar thereof and mate it with the half section 12. In that case, a separate and different half binder section 14 would be necessary, configured with a tab opening 15 at each end thereof, to match the protruding tabs 16 at each end of the binder half section 12. Other configurations are possible, whether the two half binder sections are identical or dissimilar, but capable of mating with one another.

Such an embodiment is shown in FIG. 6. In FIG. 6, two dissimilar but complementary binder half sections 32 and 34 are needed to complete the loose leaf binder 60. Protruding tabs 16 are located near both extremities of the binder half 32. Therefore, any mating binder half must have mating tab openings 15 located at its extremities. Such a binder half is shown in FIG. 6 at 34. The remaining characteristics of binder half sections 32 and 34 are identical to those described relative to binder half sections 12 and 14, shown in FIGS. 1–5.

While the foregoing detailed description has described several embodiments of this invention, it is to be understood that the above description is illustrative only and not limiting of the disclosed invention. For example, other shapes for the protruding tabs 16 and the tab openings are possible, without departing, however, from the spirit of the invention. Thus, the invention is to be limited only by the Claims as set forth below.

What is claimed is:

1. A binder for loose leaf paper, comprising:

a first and a second identical binder half section, each binder half section being matable to the other; and each of the binder half sections including a plurality of connecting members, the connecting members including a plurality of tabs and corresponding openings;

each binder half section having a top portion, the top portion including spaced apart fingers, upon mating of the binder half sections, the fingers are aligned for capturing loose paper and define releasable rings in the mated position of the binder half sections; and each binder half section having a bottom portion, the bottom portion including a leading edge and each leading edge having connecting structure for connecting one leading edge to the other upon the mating of the binder half sections;

whereby, upon mating of the binder half sections, the tabs and corresponding openings of the binder half sections mate, the fingers align and the leading edges connect.

2. The binder as set forth in claim 1, wherein the binder half sections are symmetrical.

3. The binder as set forth in claim 1, wherein the binder half sections are not identical.

4. The binder as set forth in claim 1, wherein the each binder half section opening has a flared portion defining a guide for facilitating mating between the tab and the corresponding opening.

5. The binder as set forth in claim 1, wherein each bottom portion of the binder half sections has a groove defined by a lip defining the connecting structure on the leading edge, each lip and groove is snap fit into the other promoting a snap fit connection and rigidity in the mated condition of the half binder sections.

6. The binder as set forth in claim 5, wherein the binder half sections are snap fit together through connection of the tabs and openings and the grooves.

7. The binder as set forth in claim 1, wherein the binder half sections tabs defining protruding tabs of compatible shape and size to snap fit within the openings thereby facilitating a snap fit connection between the binder half sections.

8. The binder as set forth in claim 1, wherein the fingers are curled.

9. The binder as set forth in claim 1, wherein the binder half sections are substantially semi-circular.

10. The binder as set forth in claim 1, wherein upon mating, the binder half sections define a spine.

11. The binder as set forth in claim 5, wherein the tabs and corresponding openings are regularly spaced apart.

* * * * *